US005967522A

United States Patent [19]

Corcoran et al.

[11] Patent Number: 5,967,522

[45] Date of Patent: Oct. 19, 1999

[54] AUTOMATED RANGE TARGET CARRIER SYSTEM

[76] Inventors: Thomas M. Corcoran, 6017 Peck, La Grange, Ill. 60525; Stephen J. Corcoran, 1113 S. Oak Park Ave., Oak Park, Ill. 60304; James S. Corcoran, 1018 Wenonah Ave., Oak Park, Ill. 60304

[21] Appl. No.: 08/994,011

[22] Filed: Dec. 18, 1997

[51] Int. Cl.[6] ..... F41J 7/02

[52] U.S. Cl. ..... 273/406

[58] Field of Search ..... 273/406

[56] References Cited

U.S. PATENT DOCUMENTS 4,889,346 12/1989 Destry ..... 273/406

4,890,847 1/1990 Cartee ..... 273/406

*Primary Examiner*—William H. Grieb

*Attorney, Agent, or Firm*—Patnaude & Videbeck

[57] ABSTRACT

An automated indoor pistol range target carrier has an overhead power rail along which a target-supporting, -lighting and -rotating carriage travels toward and away from the firing line. The carriage supports, rotates, repositions and lights the target and is controlled by and feeds back information as to the target's position to a central controller. Portions of the power rail are electrically insulated one from the other and function as bus bars to carry d.c. current used to operate motors and circuits in the trolley without using electrical cables. Electrical pickups in the form of wheeled trolleys wipe the bus bars to supply power to motors and lights to operate the various target carrier systems. All system components are located within the carriage which may easily be removed from the rail for service without requiring the disconnection of any power cords or cables.

44 Claims, 3 Drawing Sheets

AUTOMATED RANGE TARGET CARRIER SYSTEM

The present invention relates generally to automated small arms target range systems and, more particularly, to a target and carrier moveable along an overhead rail, including an automated carriage, a target holder for rotating and reorienting a target and a lighting system to selectively illuminate and darken the target, all of which are powered without using any exposed conventional electrical cords or cables. This application claims priority based upon Provisional Patent Application serial number 60/033,636, filed Dec. 20, 1996 and entitled "Automated Range Target Carrier System".

BACKGROUND OF THE INVENTION

Automated target systems are in widespread use, particularly in facilities such as indoor, small-arms target shooting and training facilities. A common form of such system includes a track mounted above the shooting area and extending from the firing line at one end to a distance down range at the other end. A carriage supported by the overhead track and movable therealong supports a target assembly which can include such additional accessories as a target-holding frame rotatable between front, edge and rear positions, and auxiliary lighting systems to light the target. Because the carriage is movable along the track, a shooter may have the carriage travel to the firing line for the purpose of mounting a new target or examining a target that has been fired upon and have the carriage return the target to its proper shooting position without requiring an attendant to enter the range to perform these functions. For training or competition purposes, the carriage may be moved in a preselected manner to position the target at various distances from the firing line while the target is unlit and held in the on-edge ("edge") position (that is, rotated until it is perpendicular to the firing line and cannot be seen) then halt the target, rotate it to either a "friend" or "foe" target side, illuminate the target for a specified time during which the shooter must decide whether or not to fire, then turn off the light, turn the target to the edge position, and move it to another position along the rail, forcing the shooter to expect the target to show up at random distances and exhibit random "friend" (no-shoot) or "foe" (shoot) targets.

Automated systems such as that described above are shown and described in various issued U.S. patents. U.S. Pat. No. 4,889,346 (Destry) teaches and describes an automated target range system having a carriage mounted to an overhead track and having apparatus installed upon and operating from the carriage to carry out some of the features described above. U.S. Pat. No. 4,890,847 (Cartee et al) teaches and describes a target retrieval system using a power driven cable to move the target from the target position to the retrieved position.

A reading of the Destry reference clearly identifies some of the drawbacks and problems encountered when a target system uses conventional power cables to power the individual system components. First and foremost is damage to the system that occurs when various system components are impacted by bullets, bullet fragments or shell casings. Where power is carried to various components by electrical cables, damage may occur when the cables now struck and become fully or partially severed. Where expedients such as exposed solid bars are used instead of cables, Destry identifies problems that may occur when bullet fragments lodge against such bars and create short circuits. More handguns now being used are magazine-loaded and eject spent cartridges rather than retain them in the weapon for later removal. Certain of these pistols eject the casings upward, and it is not uncommon at ranges or training facilities to have such casings land on the overhead rail and cause a short circuit or a mechanical "jam" as the carriage moves along the track.

Another problem with conventionally wired or cabled range systems is the routine on-site maintenance that must be performed to keep the cables in good working condition. Where a problem occurs that the range operator cannot repair, outside service personnel must often be called in.

All of these shortcomings result in uneconomical and inconvenient operation requiring substantial maintenance and down time to correct problems. Of course, when such problems occur, the entire range must be shut down for safety purposes in order to afford repair and maintenance personnel the opportunity to put the damaged units back into operating condition.

SUMMARY OF THE INVENTION

The present invention is drawn to an improved automatic firing range target system which overcomes a number of disadvantages of presently known systems including the propensity of such systems to be disabled by damaged or defective electrical power cables.

It is an object of the present invention to provide such a target range system with a self-propelled target carriage assembly traveling on an overhead track which does not require the connection of power cables to the carriage assembly or the track that are exposed to gunfire.

Another object of the present invention is to provide a target system easier and more economical to maintain than one requiring constant checking and replacement of power cables.

Another object of the present invention is to provide a target range system where the rail has no moving parts and all repairable parts are contained in the carriage, which may be removed from the rail and replaced with another, backup carriage, and then returned to the manufacturer for repair without having to shut down the range.

A further object of the present invention is to provide a simple and effective way to prevent the carriage from traveling past the end of the rail by automatically interrupting power to the carriage drive motor without requiring the use of switches or other moving parts.

Yet another object of the present invention is to provide a simplified manner in which the carriage is directed to move from one position on the rail to another.

The present invention resides in an automated range target system having an overhead mounting rail uniquely configured to create, as an integral part of the rail, separate electrical circuits isolated one from the other with said circuits formed by contact between individual rail components and pickup components mounted on the target carriage. A control box and control circuitry are provided to allow several functions to be powered by the same rail components, thus reducing the number of components and circuits necessary.

BRIEF DESCRIPTION OF THE DRAWINGS

These and further aspects of the present invention will become more apparent upon consideration of the accompanying drawings wherein like reference numerals designate like elements throughout the several views and which, when taken together with the following detailed description of the invention, will make the advantages of the present invention more apparent.

DETAILED DESCRIPTION OF THE INVENTION

While the following describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed.

Figure 1:
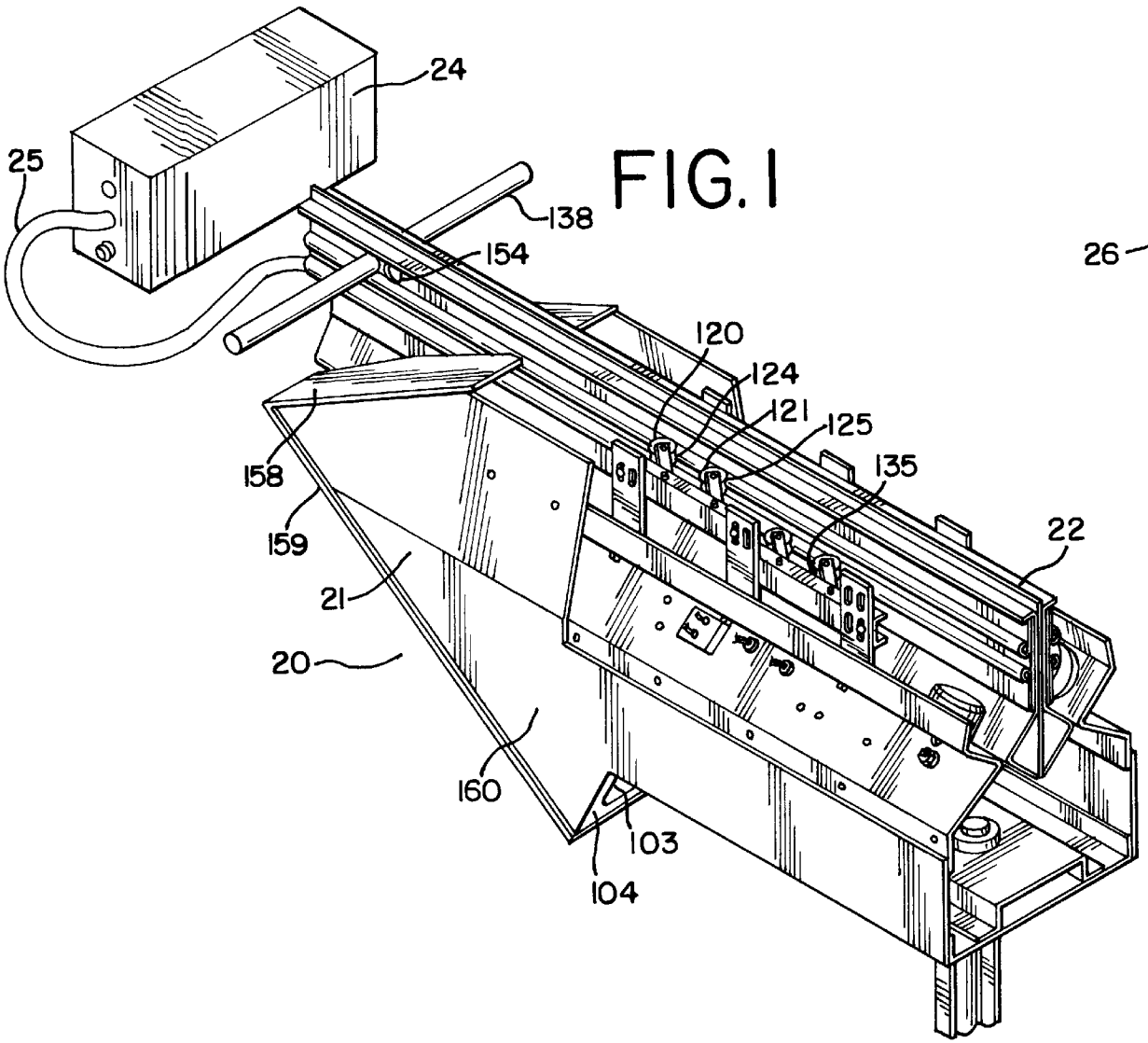
FIG. 1 is a perspective view of the target range system carriage mounted to the target range system overhead rail.

Referring now to FIG. 1, the numeral 20 indicates generally a firing range target system having a movable, target-carrying carriage 21 mounted to an overhead rail 22. In a typical installation, rail 22 extends from a point proximate the firing line of the range, that is, the line at which shooters will stand to discharge their weapons, and terminates at a point downrange, typically at a distance of 75 feet from the firing line. For purposes of convenience, the end of the rail terminating proximate the firing line will be called the forward end, and the end further from the firing line will be called the rear end.

Figure 2:
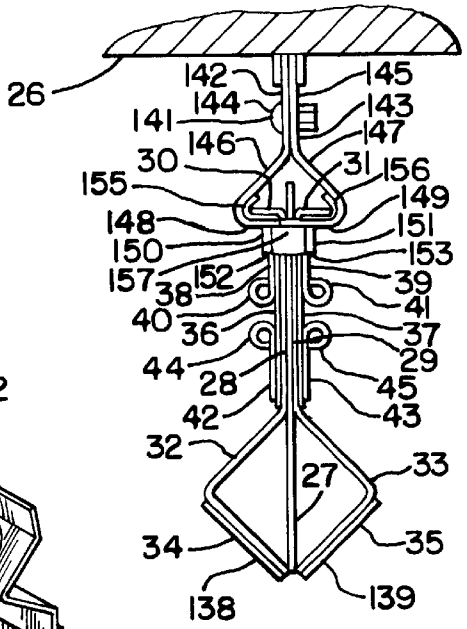
FIG. 2 is an end view of the rail of FIG. 1.

As can be seen in FIG. 2 and as will be described in more detail below, rail 22 is preferably suspended from the ceiling 26 of the firing range without requiring the use of any floor-to-rail supports.

Target system 20 also includes an electrical control box 24 within which circuitry and circuit components are placed to enable the positioning, movement and other features of carriage 21 to be controlled. While control box 24 is shown in FIG. 1 at the forward end of rail 22, it should be understood that box 24 can be positioned virtually anywhere, for example, proximate the firing line or with control boxes for other firing lanes in a central, secure location and that box 24 may be joined to rail 21 by a cable 25, shown in representative fashion in FIG. 1, it being understood that cable 25 may be drawn through a conduit, upwards through ceiling 26 or installed in any other conventional manner found to be convenient given the selected location of box 24.

Referring now to FIG. 2, the details of construction of rail 22 may be more fully explained. Rail 22 is formed from a series of metallic track members, each of which functions as an electrical bus bar and each of which is electrically insulated one from the other. Sandwiched on either side of insulating strip 27 are a pair of longitudinally extending metallic track pieces 28 and 29. As seen in FIG. 2, track piece 28 is bent at its uppermost end to form a flange 30 extending at approximately a 90° angle to track piece 28 while track piece 29 has a similar flange 31 formed thereon. The lowermost portion of track 28 is bent at approximately a 45° angle to form a first leg 32 and a second leg 34 bent at approximately a 90° angle to first leg 32. Similarly, a lowermost portion of track 29 is bent to form a first leg 33 extending at approximately a 45° angle to track 29 and a second leg 35 extending at approximately a 90° angle to first leg 33. From FIG. 2 it can also be seen that track pieces 28 and 29, when configured as described above, form mirror images of one another such that flanges 30 and 31 are essentially coextensive and such that legs 32, 33, 34 and 35 form a closed diamond configuration along the entire length of rail 22.

Sandwiched about the portions of track 28 and 29 extending generally from flanges 30 and 31, respectively, to first legs 32 and 33, respectively, are a pair of lateral insulating strips 36 and 37. Finally, to complete the construction of rail 22, a pair of upper bus strips 38 and 39 are positioned parallel one to the other along the length of track 22, separated from track pieces 28 and 29, respectively, by lateral insulating strips 36 and 37. FIG. 2 also shows the lowermost portion of upper bus strip 38 is bent outwardly in a closed circular or cylindrical configuration to create an upper track 40 while the lowermost portion of upper bus strip 39 is similarly bent to create an upper track 41.

A pair of lower bus strips 42 and 43 are positioned beneath upper bus strips 38 and 39, respectively, and are similarly separated from track pieces 28 and 29 by lateral insulation strips 36 and 37. As with upper bus strips 38 and 39, lower bus strip 42 has its uppermost portion bent in a closed circular or cylindrical configuration to form a lower track 44 while lower bus strip 43 similarly has its uppermost portion bent in a circular or cylindrical configuration to form a lower track 45.

Preferably, insulating strips 27, 36 and 37 are formed from high density polyethylene sheet material in a thickness of about 0.125 inch.

Figure 4:
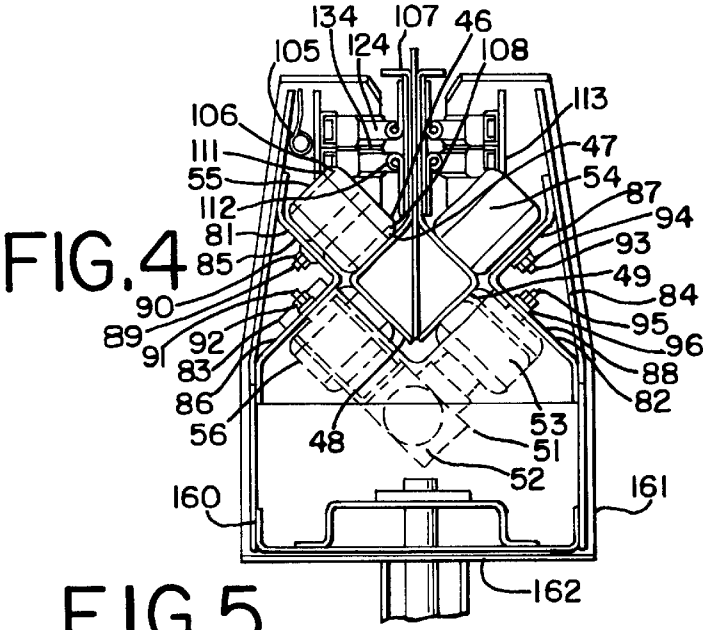
FIG. 4 is an end view showing the mounting of the carriage to the overhead rail.

As seen in FIG. 4, legs 32 and 33 have upper roller surfaces 46 and 47, respectively, while legs 34 and 35 form lower roller surfaces 48 and 49, the purpose of which will be more fully described hereinbelow.

It is a feature of the present invention that the configuration of rail 21 as described above affords no sites for shells or shell casings to collect and be retained.

It is also a feature of the present invention that each of the track pieces 28, 29, upper bus strips 38 and 39 and lower bus strips 42 and 43 may selectively have electrical current passed therealong, and that other components of the present invention are provided to allow circuits to be completed utilizing various pairs of the foregoing track pieces and upper and lower bus strips, with the creation and energization and completion of said circuits directed and controlled by the circuitry within control box 24. Thus, for a typical range installation extending to approximately 75 feet from the firing line, each track piece 28, 29 and each bus strip 38, 39, 40 and 41 forms a continuously extending source of electrical energy to power the system and its various components in a number of ways depending on the use to which the range system is to be put.

One of the functions to be accomplished by the present invention is to move carriage 21 along rail 22 and stop it at a predetermined or selected position.

To accomplish this, carriage 21 includes two trolley assemblies, each assembly having four urethane wheels adapted and positioned to contact upper roller surfaces 46 and 47 and lower roller surfaces 48 and 49, with one of the wheels in one of the trolley assemblies being a motor-driven drive wheel.

Referring to FIG. 4, the numeral 51 indicates generally a rear, powered, four-wheel trolley having a drive motor 52, a drive wheel 53 and idler wheels 54, 55 and 56. In a preferred embodiment, wheels 53, 54, 55 and 56 are formed from urethane. Such wheels are commonly used in conventional roller skates. As seen in FIG. 4, wheels 53, 54, 55 and 56 are arranged such that wheel 53 contacts and rolls along lower roller surface 48, wheel 54 rolls along upper roller surface 47, wheel 55 rolls along and contacts upper roller surface 46 and wheel 56 rolls along and contacts lower roller surface 48. Motor 52 is a reversible, direct current motor preferably operating at 24 volts d.c. and 20 in.-lb. of torque. An example of one such motor is the Model RT 2500 motor manufactured and sold by Groshoop, Inc. of Sioux Center, Iowa.

Figure 5:
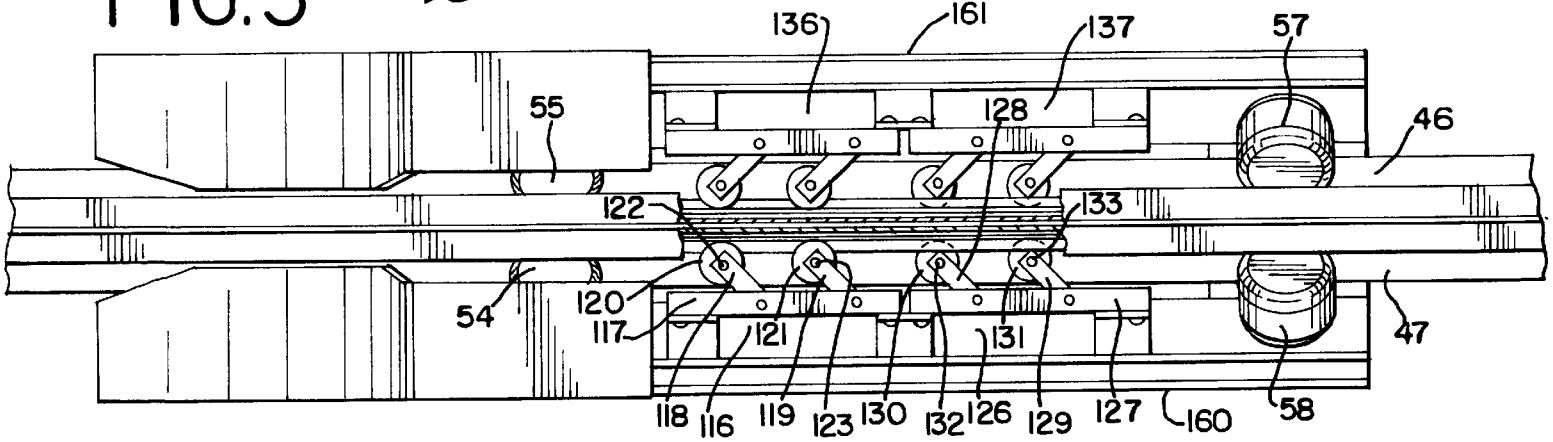
FIG. 5 is a top view taken along 5—5 of FIG. 4 with a portion of the carriage cover removed to reveal several of the trolley connectors for the accessory circuits.

Referring to FIG. 5, a top view of the carriage and rail assembly, it can be seen that idler wheels 54 and 55 of trolley 50 roll along, respectively, upper roller surfaces 46 and 47. The rear trolley 51 is identical in configuration and construction to forward trolley 50 except that all four wheels on rear trolley 51 are idler wheels, that is, there is no motor driven wheel on rear trolley 51. As seen in FIG. 5, rear idler wheels 57 and 58 also contact and ride along, respectively, upper roller surfaces 46 and 47. Lower rear idler wheels 59 and 60, though not specifically herein shown, should likewise be understood to contact and roll along, respectively, lower roller surfaces 48 and 49. Preferably, drive wheel 53 and idler wheels 54, 55, 56, 57, 58, 59 and 60 are manufactured from high density urethane and are approximately 2 3/16 inch in diameter.

As seen in FIG. 4, a pair of generally V-shaped wheel mount brackets 81 and 82 are secured to inner side walls 83 and 84 of carriage 22. As seen in FIG. 4, wheel 55 is rotatably attached to bracket leg 85 of bracket 81 by axle bolt 89 and nut 90. In like fashion, wheel 56 is attached to bracket leg 86 by axle bolt 91 and axle nut 92, wheel 54 is attached to bracket leg 87 by axle bolt 93 and axle nut 94, and drive wheel 53 is attached to bracket leg 88 by axle bolt 95 and axle nut 96. A similar mounting bracket arrangement is used for rear trolley 51.

Figure 6:
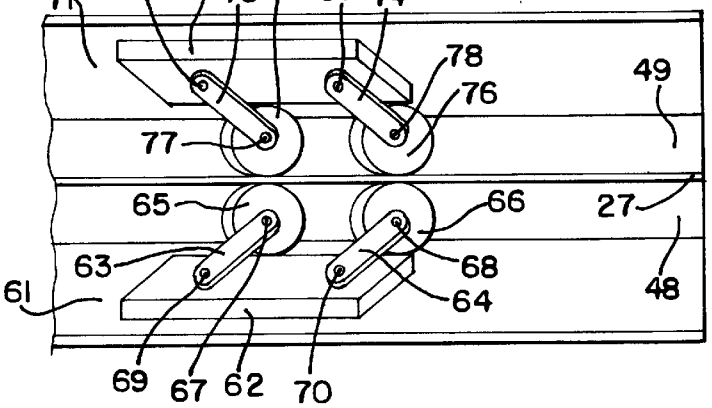
FIG. 6 is a partial view with a portion of the bottom carriage cover removed to reveal several of the trolley connectors for the carriage drive motor.

The power to operate drive motor 52 comes from the circuit that is completed when control box 24 directs voltage through track pieces 28 and 29. As seen in FIG. 6, an electrical pick-up trolley 61 having a trolley body 62 and a pair of wheel mounts 63 and 64 to which are mounted, respectively, composite carbon/graphite wheels 65 and 66. Each said wheel is attached to its corresponding mount with a pin or axle 67, 68 and it is to be understood that wheels 65, and 66, axles 67 and 68 and wheel mounts 63 and 64 are all fashioned from electrically conductive material. FIG. 6 further shows that trolley 61 is positioned such that wheels 65 and 66 are brought to bear on lower roller surface 48. In one embodiment, wheel mount 63 has terminal 69 attached or connected thereto, while wheel mount 64 has terminal 70 attached or connected thereto.

In similar fashion, electrical pick-up trolley 71 is configured and positioned correspondingly to trolley 61 to act as an electrical pick-up for lower roller surface 49. Trolley 71 has a trolley body 72 to which wheel mounts 73 and 74 are mounted. Composite carbon/graphite pick-up wheels 75 and 76 are rotatably mounted, respectively, to wheel mounts 73 and 74 and are held in place by conductive axles 77 and 78, respectively. Each wheel mount 73 and 74 terminates in a terminal 79, 80 or, alternatively, in a connection leading to an electrically conductive terminal.

As seen in FIG. 6, wheels 65, 66, 75 and 76 are formed with flat peripheries to maximize the area of contact between each wheel and its corresponding lower roller surface. Trolleys 61 and 71 are also oriented to bring wheels 65, 66, 75, 76 into contact with roller surfaces 48 and 49, respectively, such that said roller surfaces are tangent to the peripheries of said wheels.

In a preferred embodiment, wheel mounts 63, 64, 73 and 74 may be spring biased or otherwise biased to hold wheels 65, 66,75 76 against surfaces 48 and 49 as carriage 22 is moved.

To complete an electrical circuit to actuate drive motor 52, wires or cables are connected between, for example, terminal 69 and motor 52, and terminal 79 and motor 52. When track piece 28 is energized, a circuit may then be completed from control box 24, track piece 28, wheel 65, terminal 69, motor 52, terminal 79, wheel 75 and track piece 29. Where a positive voltage is supplied to track piece 28, and a neutral connection completed to track piece 29, carriage 22 will move in a first direction. When a positive voltage is supplied to track piece 29 and a connection to neutral supplied to track 28, the polarity of the voltage supplied to drive motor 52 is reversed and carriage 22 will move in the opposite direction.

Figure 3:
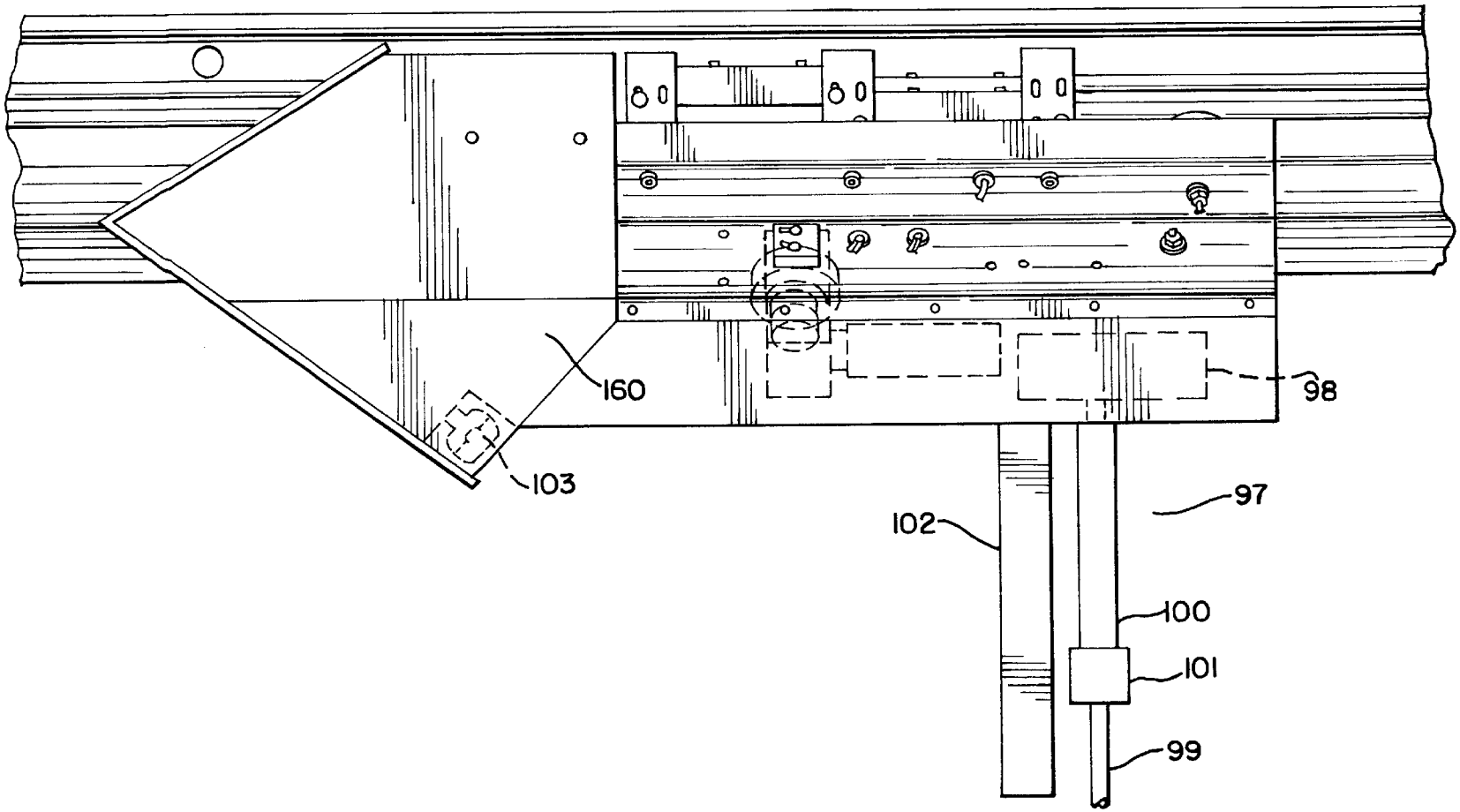
FIG. 3 is an enlarged side detail of the rail and carriage arrangement.

Referring now to FIG. 3, the numeral 97 indicates generally a target holding and turning assembly which includes a turning motor 98, a target-holding shaft 99, an outer sleeve 100 and a support bearing collar 101. Motor 98 is preferably a 12–14 volt d.c. motor of the general type used, for example, to operate the power windows in an automobile. One such motor used satisfactorily is a power window motor manufactured for Chrysler Corporation by Nippondenso.

As described hereinabove, operation of system 10 requires that a target be turned quickly through an arc of rotation of 90° to bring the target from a "friend" side to an edge position to a "foe" side. To effect such an increment of rotation, a series of limit switches not herein specifically shown may be mounted proximate the position at which shaft 99 extends from motor 98 such that rotation through an arc of 90° will open one such switch and interrupt the flow of current to motor 98. To protect shaft 99, sleeve 100 and bearing 101, a shield 102 is provided and is positioned between shaft 99 and the firing line. Preferably, shield 102 is formed from a piece of angle iron with the apex or edge at which the angle iron sides are joined pointing at the firing line to deflect to the side any shots striking shield 102.

A clamp or other holder of known, conventional type can be attached to shaft 99 at its lowermost end to serve as a site for the attachment of a target backing sheet or a free-hanging target.

Referring now to FIGS. 1 and 3, the numeral 103 identifies an incandescent lamp angled downward from a lower compartment 104 of carriage 22 and is angled down to illuminate a target held on shaft 99. Preferably, resistive circuitry is provided to illuminate lamp 103 at several different wattages to simulate various lighting circumstances for purposes of firearms training or competition.

Another feature of the present invention is a position feed/feedback system to identify the position of carriage 21 along rail 22 and to instruct carriage 21 to travel to a new position that operates without requiring the use of signal detectors, indicators or generators positioned along or attached to rail 22. Instead of detecting position by contacting such detectors during travel, the present invention uses a pulse counter mounted proximate one of the carriage idler wheels to determine how far the carriage must travel in a selected direction to reach the new location, calculate how many revolutions the wheel has to make to traverse this distance, count the number of revolutions made by the wheel and halt power to the carriage transport motor 52 when the correct number of revolutions has been made. As an example, FIG. 4 shows wheel 55 configured as part of the position feed/feedback circuit. If, for example, wheel 55 is approximately 2 1/16 in. in diameter, each full revolution of wheel 55 results in a travel increment of about 6.5 in. To travel from a position 45 feet down range to one 60 feet down range means traveling a total of 15 feet, or about 415.4 revolutions of wheel 55. As will be described, means are provided to detect each ¼ revolution, or each 1.6 inch of linear travel of wheel 55, increasing the accuracy with which the new position along rail 21 can be set.

Referring now to FIG. 4, the numeral 105 indicates generally a proximity switch used to detect magnetic fields or pulses. One such switch preferably used is manufactured by Ademco as its model number N 6572. Switch 105 is mounted proximate wheel 55 which, as shown, has four channels 106, 107, 108 and 109 milled in from wheel face 110 and spaced 90° one from another. Set into each channel is a permanent magnet 111, 112, 113 and 114. Each ¼ turn of wheel 55 thus brings one permanent magnet in close enough proximity to switch 105 to trip said switch and create a pulse that can be transmitted to control box 24 and thereafter counted. In the preferred embodiment of the invention, the pulses are detected by a programmable loop controller (PLC) located in box 24 and this information is transmitted to a computer which then displays the carriage travel and position on a video display.

Because this system does not use indicators along rail 21 to transmit an absolute position signal, it is important that the pulse counter be set to zero when carriage 22 is at the firing line. To accomplish this, a limit switch 115 may be attached to rail 21, as shown in FIG. 1, or may be secured directly to ceiling 26 at the firing line, or may be secured directly to carriage 22. Preferably, the switch is of the type that is tripped magnetically and a permanent magnet can be attached to carriage 22 in position to activate switch 115 as carriage 22 passes by. Switch 115 is hard-wired to control box 24 and is used to signal the PLC to zero out the position counter. Other, mechanical switch arrangements may also be used. For example, a mechanical switch may be tripped by a projecting tab or bolt attached to carriage 22.

When carriage 22 passes the firing line to travel downrange, switch 115 is tripped, the counter is zeroed, and the position of carriage 22 is then calculated and updated by counting the revolutions of wheel 55 and adding increments of distance as carriage 22 travels downrange, and subtracting increments as carriage 22 returns uprange. One such switch used successfully is manufactured by Ademco as its model F-22.

Each of the foregoing described functions calls for the application of electrical power in order to operate the above-described components or requires a conductive path to collect and transmit electrical pulses. For example, light 103 requires voltage supplied at three increments in order to provide selected levels of illumination for a range target. Motor 98 must be energized to turn target shaft 99. Means must be provided to feed back pulse data from proximity switch 105 to control box 24. In order to provide power in circuits separate from that defined by track pieces 28 and 29, for selected operation of other system components, two more sets of electrically isolated and interconnectable track pieces are supplied, previously identified as upper bus strips 38 and 39 and lower bus strips 42 and 43. A series of electrical pick-up trolleys carrying conductive wheels, similar to trolleys 61 and 71 are used to transmit electrical power using upper tracks 40 and 41 and lower tracks 44 and 45 as described below.

Referring now to FIG. 5, the numeral 116 identifies an upper electrical pickup trolley similar in construction and function to trolleys 61 and 71 described above. Trolley 116 will be described in detail, it being understood that three other such trolleys are also provided, all being of similar construction. The purpose of upper trolley 116 is to be part of an electrically conductive circuit by providing an electrically conductive contact with upper track 40 and by providing terminal connections for internal wiring to extend from trolley 116 to a selected system component.

Upper pickup trolley 116 has a trolley body 117 which acts as a terminal board and to which a pair of wheel mounts 1 18, 119 are attached. Preferably, mounts 118 and 119 are spring-biased or -loaded to urge mounts 118, 119 toward upper track 40. A pair of composite carbon/graphite pickup wheels 120, 121 are rotatably mounted to mounts 118, 119 by conductive axles 122, 123. As seen in FIG. 4, wheel 120 has a peripherally-extending groove or channel 124 formed therein to fit around and overlap upper rail 40 adding stability to the contact between trolley 116 and upper rail 40. FIG. 1 shows that wheel 121 has a similar groove 125 formed therein and, indeed, the remaining wheels on the trolleys described below are identical to and interchangeable with grooved wheels 120, 121.

A lower pickup trolley 126 is similar in construction to upper trolley 116 and furnishes contact with lower track 44, and has a trolley body 127 which acts as a terminal board and to which a pair of wheel mounts 128, 129 are attached. Preferably, mounts 128 and 129 are spring-biased or -loaded to urge mounts 128, 129 toward lower track 44. A pair of composite carbon/graphite pickup wheels 130, 131 are rotatably mounted to mounts 118, 119 by conductive axles 132, 133. As seen in FIG. 4, wheel 130 has a peripherally-extending groove or channel 134 formed therein to fit around and overlap lower rail 44 adding stability to the contact between trolley 126 and lower rail 44. FIG. I shows that wheel 131 has a similar groove 135 formed therein and, indeed, the remaining wheels on the trolleys described below are identical to and interchangeable with grooved wheels 130, 131.

Two additional trolleys, upper trolley 136 and lower trolley 137 are provided as shown in FIG. 5 and are of similar-enough construction and function that identification of the individual parts of each is not repeated here. Trolley 136 provides conductive contact with upper track 41, while lower trolley 137 provides conductive contact with lower track 45.

Use of trolleys 116, 126, 136 and 137 to power various functions of carriage 22 is made by connecting individual conductive wires or cables from, for example, upper rail 41, trolley 136, the positive side of light 103 and from lower rail 45, trolley 137 and the neutral side of light 103. When upper rail 41 is energized by control box 24 and lower rail 45 is connected to neutral by control box 24, light 103 will be energized. In similar fashion, when a first terminal of target-turning motor 98 is attached, by wire, to upper trolley 116 and a second terminal of motor 98 is attached, by wire, to lower trolley 126, motor 98 will turn in a first direction when upper rail 40 is energized with a positive voltage and lower rail 44 is connected to neutral, and in an opposite direction when lower rail 44 is energized with a positive voltage and upper rail 40 is connected to neutral, all of these functions being carried out at control box 24.

It should now be apparent that three separate conductive circuits result from the present construction of rail 21. It should also be apparent that more than three system components may be powered by these three circuits. For example, when carriage 22 is traveling, or target mounting shaft 99 is turned to the edge position, light 103 is not illuminated. One side of light 103 may then be set to operate from one of the contacts for either motor 98 or carriage motor 52 but only when said contact is not energized.

It is a feature of the present invention that the operating mechanisms for the functions performed by the target system are contained in carriage 22 and that rail 21 has no moving parts to wear out or require periodic servicing. As seen in representative fashion in FIG. 1, the firing line end of rail 21 may be open, allowing carriage 22 to be removed simply by rolling it by hand past the end of rail 21. This substantially eliminates the need for on-site servicing when a problem occurs with carriage 22 because a new or backup carriage can simply be reinstalled on rail 21 while the carriage in need of repair or servicing is taken to a work area or is shipped back to the manufacturer or an authorized service representative for off-site repair. To prevent inadvertent removal of carriage 22, a stop 138 may be installed across rail 21 as shown in FIG. 1.

As an additional safety feature, means are provided to interrupt power to motor 52 at the extreme ends of rail 21 to prevent carriage 22 from traveling under power to the very ends of rail 22. As seen in FIG. 1, lengths of non-conductive, insulating strips 138, 139 are attached, respectively, to the ends of lower roller surfaces 48 and 49 at both ends of rail 21 to interrupt conductive contact between said surfaces and pickup wheels 65 and 66, thus deenergizing motor 52.

FIG. 1 also shows a hanger bracket 141 usable to secure rail 21 to ceiling 26. As seen, hanger bracket 141 consists of a pair of side pieces 142, 143 having first, straight depending segments 144, 145 which diverge outwardly, forming legs 146, 147, then are bent to form horizontal legs 148, 149 each of which is bent at its outer extremity to form a pair of depending ears 150, 151 through which apertures 152, 153 are formed. Similarly sized apertures 154 are formed along rail 21 as seen in FIG. I and are positioned such that apertures 152, 153 and 154 register one with another when rail flanges 30, 31 are inserted between diverging legs 146, 147 and are supported by horizontal legs 148, 149. A pair of insulating strips 155, 156 prevent metal-to-metal contact between legs 148, 149 and flanges 30, 31 to prevent short circuits. A bolt 157 is then passed through aligned apertures 152, 153 and 154 to secure hanger 141 to rail 21. Hanger 141 is secured to ceiling 26 in any convenient fashion, preferably in a manner to extend hanger 141 up or down in order to facilitate the leveling of rail 21.

While the various views of carriage 22 presented herein have shown the internal mechanisms associated with carriage 22, it is to be understood that the drawings have depicted carriage 22 with certain of its protective panels broken out for purposes of clarity. In its fully assembled form, carriage 22 is completely enclosed by upper and lower front plates 158, 159, left and right side plates 160, 161 and bottom plate 162 to protect the internal mechanisms of carriage 22 from bullets or shell casings. Preferably, the housing for carriage 22 is made from 400 Brinel hardness abrasion resistant steel with a thickness of ¼ inch.

What is claimed is:

1. An automated range target carrying system of the type having a substantially horizontally-mounted rail having a substantially horizontal axis along which a target carrier is moved toward and away from a firing line, said range target carrying system comprising:

a carriage rail consisting of at least two electrically conductive rail sections separated one from the other by non-conductive insulating material;

a carriage assembly moveable along said carriage rail;

said rail sections forming an electrically conductive path to and from said carriage assembly without the use of electrical cables;

means for movably supporting said carriage assembly on said carriage rail;

means for driving said carriage assembly along said carriage rail responsive to the passage of electrical energy through said rail sections, said driving means including an electrical motor assembly mounted to said carriage assembly, said electric motor assembly including an electric motor;

said driving means further including means for coupling said electrical motor assembly to said moveable support means to move said carriage assembly with respect to said carriage rail; and means for controlling the operation of said carriage assembly on and along said carriage rail.

2. The apparatus as recited in claim 1 wherein said carriage rail comprises:

a first longitudinally-extending rail section having a first upper, generally horizontally-extending flange extending outwardly from said axis, a first web section depending vertically from and integrally formed with and coextensive with said first flange, a second web section integral with said first web section and extending away from said axis at approximately a 45° angle to said first web section, and a third web section integral with said second web section and extending toward said axis at approximately a 90° angle to said second web section;

a second longitudinally-extending rail section formed as a mirror image of said first rail section, said second rail section having a second upper, generally horizontally-extending flange extending outwardly from said axis, a fourth web section depending vertically from and integrally formed with and coextensive with said second flange, a fifth web section integral with said fourth web section extending away from said axis at approximately a 45° angle to said fourth web section, and a sixth web section integral with said fifth web section and extending toward said axis at approximately a 90° angle to said fifth web section;

said first and second rail sections attached in face-to-face relationship along said axis whereby said second, third, fifth and sixth web sections define a longitudinally extending substantially square tube; and a layer of said insulating material positioned between said first and second rail sections to electrically insulate said first and second rail sections from one another.

3. The apparatus as recited in claim 2 wherein said carriage rail further comprises:

first and second electrically conductive bus bars aligned parallel to each other and attached to said first web section extending along the length of said first rail section, and a first layer of said insulating material positioned between said first and second bus bars and said first rail section.

4. The apparatus as recited in claim 3 wherein each said bus bar is formed as a flat, plate having at least one edge the longest dimension of which extends along the length of said carriage rail, said one edge being rolled to form a generally cylindrical track extending along the length of said carriage rail.

5. The apparatus as recited in claim 2 wherein each of said first and second rail sections is attached to said control means to form a first electrically conductive circuit when said first and second rail sections are electrically bridged.

6. The apparatus as recited in claim 4 wherein said pair of said bus bars is attached to said control means to form a second conductive circuit when said pair of bus bars is electrically bridged.

7. The apparatus as recited in claim 2 wherein said carriage assembly includes a housing having front, top, left side, right side and bottom housing panels;

said moveable support means comprising at least one pair of bracket legs disposed within said housing, the first leg of said pair having a first plurality of trolley wheels rotatably mounted thereto, the second leg of said pair having a second plurality of trolley wheels rotatably mounted thereto, said first leg configured to bring said first trolley wheels into rolling contact with said second web section and said second leg configured to bring said second trolley wheels into rolling contact with said fourth web section whereby said carriage assembly may be rolled along said rail assembly in the direction of said axis.

8. The apparatus as recited in claim 7 wherein said first bracket leg has a third plurality of trolley wheels and said second bracket leg has a fourth plurality of trolley wheels, said first bracket leg configured to bring said third trolley wheels into rolling contact with said third web section and said second bracket leg configured to bring said fourth trolley wheels into rolling contact with said sixth web section when said first and second trolley wheels are in rolling contact with said second and fourth web sections.

9. The apparatus as recited in claim 8 wherein one of said first or second trolley wheels is driven by said motor.

10. The apparatus as recited in claim 8 wherein one of said third or fourth trolley wheels is driven by said motor.

11. The apparatus as recited in claim 5 wherein said carriage assembly includes a first pickup trolley having at least one pickup wheel rotatably attached to said first pickup trolley by a first wheel bracket and a second pickup trolley having at least one pickup wheel rotatably attached to said second pickup trolley by a second wheel bracket, said pickup wheels and said wheel brackets manufactured from electrically conductive material; and means for forming an electrically conductive path from said wheel to said bracket.

12. The apparatus as recited in claim 11 wherein said first pickup trolley is mounted to said carriage assembly to bring each said first pickup wheel into rolling and electrically-conductive contact with said second or third web section and said second pickup trolley is mounted to said carriage assembly to bring each said second pickup wheel into rolling and electrically-conductive contact with said fifth or sixth web section.

13. The apparatus as recited in claim 12 wherein said carriage assembly includes a pickup shunt attached to said first and second pickup trolley wheel brackets to form a first electrically-conductive bridging path between said first and second rail sections.

14. The apparatus as recited in claim 13 wherein said first bridging path includes said electric motor, whereby electrically energizing said first and second rail sections actuates said electrical motor, thereby moving said carriage assembly along said rail.

15. The apparatus as recited in claim 6 wherein said carriage assembly includes first and second bus pickup assemblies, said first bus pickup assembly having at least one electrically-conductive bus wheel rotatably mounted thereto and positioned to contact and roll along said track on said first bus bar, and said second bus pickup assembly having at least one electrically-conductive bus wheel rotatably mounted thereto and positioned to contact and roll along said track on said second bus bar.

16. The apparatus as recited in claim 15 and further including a first bus shunt forming a second electrically-conductive bridging path between said electrically-conductive bus wheels on said first and second bus pickup assemblies, said first and second bus pickup assemblies, said first bus shunt and said control means forming said second conductive path.

17. The apparatus as recited in claim 16 wherein said second bridging path includes an electrically-activated auxiliary mechanism, whereby said auxiliary mechanism is operated when said second bridging path is actuated.

18. The apparatus as recited in claim 17 wherein said auxiliary mechanism is a rotatable target holder.

19. The apparatus as recited in claim 18 wherein said target holder comprises a generally support for holding a planar target having front and rear surfaces and left and right edges, said target holder including a rotatable target shaft having upper and lower ends and depending downward from said carriage assembly, said target support positioned at said lower shaft end, said upper shaft end attached to an electrical motor, said control means adapted to operate said motor to rotate said shaft through selected arcs of rotation to present said front surface or rear surface as a target or to present said left edge or said right edge to conceal said front and rear surfaces.

20. The apparatus as recited in claim 17 wherein said auxiliary mechanism is a target-illuminating electric light.

21. The apparatus as recited in claim 20 wherein said control means includes means to selectively illuminate said light to illuminate a target carried by said carriage assembly.

22. The apparatus as recited in claim 20 wherein said control means includes means to preclude the illumination of said light while said carriage assembly is moving along said carriage rail.

23. The apparatus as recited in claim 17 wherein said auxiliary mechanism is means for positioning said carriage assembly at selected locations along said carriage rail.

24. The apparatus as recited in claim 23 wherein said positioning means includes at least one counter wheel rotatably mounted to said carriage assembly and positioned to contact said carriage rail whereby movement of said carriage assembly rotates said counter wheel, said counter wheel having a slug of ferromagnetic material embedded therein;

a magnetically-operable proximity switch positioned proximate said counter wheel such that said switch is operated each time said counter wheel rotates to bring said slug proximate said switch;

means for detecting the operation of said switch and converting the operation of said switch into electrical signals transmitted to a counter included in said control means; and means for zeroing said counter whenever said carriage assembly reaches a preselected location along said carriage rail whereby said control means is enabled to determine the length of travel and position of said carriage assembly with respect to said preselected location by counting the number of rotations of said counter wheel and multiplying the rotations by the circumference of the counter wheel.

25. The apparatus as recited in claim 24 wherein said zeroing means comprises a limit switch positioned to be tripped when said carriage reaches said preselected location, and means for electrically connecting said limit switch to said control means.

26. The apparatus as recited in claim 24 wherein said control means further includes means to deenergize said motor when said carriage is moving toward said firing line and reaches said preselected location.

27. The apparatus as recited in claim 24 wherein said control means includes means for repositioning said carriage assembly from a first position to a second position along said carriage rail by determining the distance and direction the carriage assembly must travel from said first position to said second position, determining a rotation count and direction of rotation said counter wheel must make to reach said second position and energizing said motor assembly to move said carriage assembly in said direction of travel and counting the number of rotations of said counter wheel and deenergizing said motor assembly when said counter wheel has been rotated in said direction of travel for said rotation count.

28. The apparatus as recited in claim 17 wherein said carriage rail includes third and fourth electrically conductive bus bars aligned parallel to each other and attached to said fourth web section extending along the length of said second rail section; and said carriage assembly includes third and fourth bus pickup assemblies, said third bus pickup assembly having at least one electrically-conductive bus wheel rotatably mounted thereto and positioned to contact and roll along said third bus bar, and said fourth bus pickup assembly having at least one electrically-conductive bus wheel rotatably mounted thereto and positioned to contact and roll along said fourth bus bar.

29. The apparatus as recited in claim 28 and further including a second bus shunt forming a third electrically-conductive bridging path between said electrically-conductive bus wheels on said third and fourth bus pickup assemblies, said third and fourth bus pickup assemblies, said second bus shunt and said control means forming said third conductive path.

30. The apparatus as recited in claim 29 wherein said third bridging path includes an electrically-activated auxiliary mechanism, whereby said auxiliary mechanism is operated when said third bridging path is actuated.

31. The apparatus as recited in claim 7 wherein said panels are formed from 400 Brinel hardness abrasion resistant steel.

32. The apparatus as recited in claim 31 wherein said front panel is are formed with a thickness of at least ¼ inch.

33. The apparatus as recited in claim 7 wherein said front panel has first and second panel surfaces meeting at a horizontally extending edge, said first panel surface inclined downward from said edge and said second panel inclined upward from said edge.

34. An automated range target carrying system of the type having a substantially horizontally-mounted rail having a substantially horizontal axis along which a target carrier is moved toward and away from a firing line, said range target carrying system comprising:

a carriage rail having first and second longitudinally-extending rail sections said first rail section having a first upper, generally horizontally-extending flange extending outwardly from said axis, a first web section depending vertically from and integrally formed with and coextensive with said first flange, a second web section integral with said first web section and extending away from said axis at approximately a 45° angle to said first web section, a third web section integral with said second web section and extending toward said axis at approximately a 90° angle to said second web section, said second longitudinally-extending rail section formed as a mirror image of said first rail section, said second rail section having a second upper, generally horizontally-extending flange extending outwardly from said axis, a fourth web section depending vertically from and integrally formed with and coextensive with said second flange, a fifth web section integral with said fourth web section extending away from said axis at approximately a 45° angle to said fourth web section, a sixth web section integral with said fifth web section and extending toward said axis at approximately a 90° angle to said fifth web section, said first and second rail sections attached in face-to-face relationship along said axis whereby said second, third, fifth and sixth web sections define a longitudinally extending substantially square tube, a first layer of said insulating material positioned between said first and second rail sections to electrically insulate said first and second rail sections from one another, first and second electrically conductive bus bars aligned parallel to each other and attached to said first web section extending along the length of said first rail section, and a second layer of said insulating material positioned between said first and second bus bars and said first rail section, third and fourth electrically conductive bus bars aligned parallel to each other and attached to said fourth web section extending along the length of said second rail section;

a third layer of said insulating material positioned between said third and fourth bus bars and said second rail section;

a carriage assembly moveable along said carriage rail, said carriage rail forming at least one electrically conductive path to and from said carriage assembly without the use of electrical cables;

means for movably supporting said carriage assembly on said carriage rail;

means for driving said carriage assembly along said carriage rail responsive to the passage of electrical energy through said rail sections, said driving means including an electrical motor assembly mounted to said carriage assembly, said electric motor assembly including an electric motor;

said driving means further including means for coupling said electrical motor assembly to said moveable support means to move said carriage assembly with respect to said carriage rail; and means for controlling the operation of said carriage assembly on and along said carriage rail, each of said first and second rail sections being attached to said control means to form a first electrically conductive circuit when said first and second rail sections are electrically bridged, and each of said first and second bus bars being attached to said control means to form a second conductive circuit when said first and second bus bars are electrically bridged, and each of said third and fourth bus bars being attached to said control means to form a third conductive circuit when said third and fourth bus bars are electrically bridged.

35. The apparatus as recited in claim 34 wherein said carriage assembly includes a housing having front, top, left side, right side and bottom housing panels, said front panel having first and second panel surfaces meeting at a horizontally extending edge, said first panel surface inclined downward from said edge and said second panel inclined upward from said edge.

36. The apparatus as recited in claim 34 wherein said moveable support means comprises at least one pair of bracket legs disposed within said housing, the first leg of said pair having a first plurality of trolley wheels and a third plurality of trolley wheels rotatably mounted thereto, the second leg of said pair having a second plurality of trolley wheels and a fourth plurality of trolley wheels rotatably mounted thereto, said first leg configured to bring said first trolley wheels into rolling contact with said second web section and said third trolley wheels into rolling contact with said third web section, said second leg configured to bring said second trolley wheels into rolling contact with said fourth web section and said fourth trolley wheels into rolling contact with said sixth web section when said first and second trolley wheels are in rolling contact with said second and fourth web sections, whereby said carriage assembly may be rolled along said rail assembly in the direction of said axis, at least one of said first, second, third or fourth trolley wheels being coupled to and driven by said motor.

37. The apparatus as recited in claim 36 wherein said carriage assembly further includes a first pickup trolley having at least one pickup wheel rotatably attached to said first pickup trolley by a first wheel bracket and a second pickup trolley having at least one pickup wheel rotatably attached to said second pickup trolley by a second wheel bracket, said pickup wheels and said wheel brackets manufactured from electrically conductive material;

means for forming an electrically conductive path from said wheel to said bracket;

said first pickup trolley mounted to said carriage assembly to bring each said first pickup wheel into rolling and electrically-conductive contact with said second or third web section and said second pickup trolley mounted to said carriage assembly to bring each said second pickup wheel into rolling and electrically-conductive contact with said fifth or sixth web section; and a pickup shunt attached to said first and second pickup trolley wheel brackets to form a first electrically-conductive bridging path between said first and second rail sections, said first bridging path including said electric motor, whereby electrically energizing said first and second rail sections actuates said electrical motor, thereby moving said carriage assembly along said rail.

38. The apparatus as recited in claim 36 wherein said carriage assembly includes first, second, third and fourth bus pickup assemblies, said first bus pickup assembly having at least one electrically-conductive bus wheel rotatably mounted thereto and positioned to contact and roll along said first bus bar, said second bus pickup assembly having at least one electrically-conductive bus wheel rotatably mounted thereto and positioned to contact and roll along said second bus bar, said third bus pickup assembly having at least one electrically-conductive bus wheel rotatably mounted thereto and positioned to contact and roll along said third bus bar, said fourth bus pickup assembly having at least one electrically-conductive bus wheel rotatably mounted thereto and positioned to contact and roll along said fourth bus bar;

a first bus shunt forming a second electrically-conductive bridging path between said electrically-conductive bus wheels on said first and second bus pickup assemblies, said first and second bus pickup assemblies, said first bus shunt and said control means forming said second conductive path;

a second bus shunt forming a second electrically-conductive bridging path between said electrically-conductive bus wheels on said third and fourth bus pickup assemblies, said third and fourth bus pickup assemblies, said second bus shunt and said control means forming said second conductive path, said second bridging path includes a first electrically-activated auxiliary mechanism, whereby said auxiliary mechanism is operated when said second bridging path is actuated, and said third bridging path includes a second electrically-activated auxiliary mechanism, whereby said auxiliary mechanism is operated when said second bridging path is actuated.

39. The apparatus as recited in claim 38 wherein one said auxiliary mechanism is a rotatable target holder, said target holder comprising a generally support for holding a planar target having front and rear surfaces and left and right edges, said target holder including a rotatable target shaft having upper and lower ends and depending downward from said carriage assembly, said target support positioned at said lower shaft end, said upper shaft end attached to an electrical motor, said control means adapted to operate said motor to rotate said shaft through selected arcs of rotation to present said front surface or rear surface as a target or to present said left edge or said right edge to conceal said front and rear surfaces.

40. The apparatus as recited in claim 38 wherein one said auxiliary mechanism is a target-illuminating electric light and said control means includes means to selectively illuminate said light to illuminate a target carried by said carriage assembly.

41. The apparatus as recited in claim 38 wherein one said auxiliary mechanism is means for positioning said carriage assembly at selected locations along said carriage rail, said positioning means includes at least one counter wheel rotatably mounted to said carriage assembly and positioned to contact said carriage rail whereby movement of said carriage assembly rotates said counter wheel, said counter wheel having a slug of ferromagnetic material embedded therein;

a magnetically-operable proximity switch positioned proximate said counter wheel such that said switch is operated each time said counter wheel rotates to bring said slug proximate said switch;

means for detecting the operation of said switch and converting the operation of said switch into electrical signals transmitted to a counter included in said control means; and means for zeroing said counter whenever said carriage assembly reaches a preselected location along said carriage rail whereby said control means is enabled to determine the length of travel and position of said carriage assembly with respect to said preselected location by counting the number of rotations of said counter wheel and multiplying the rotations by the circumference of the counter wheel.

42. The apparatus as recited in claim 41 wherein said zeroing means comprises a limit switch positioned to be tripped when said carriage reaches said preselected location, and means for electrically connecting said limit switch to said control means.

43. The apparatus as recited in claim 41 wherein said control means further includes means to deenergize said motor when said carriage is moving toward said firing line and reaches said preselected location.

44. The apparatus as recited in claim 41 wherein said control means includes means for repositioning said carriage assembly from a first position to a second position along said carriage rail by determining the distance and direction the carriage assembly must travel from said first position to said second position, determining a rotation count and direction of rotation said counter wheel must make to reach said second position and energizing said motor assembly to move said carriage assembly in said direction of travel and counting the number of rotations of said counter wheel and deenergizing said motor assembly when said counter wheel has been rotated in said direction of travel for said rotation count.

* * * * *